US007856941B2

(12) United States Patent
Nelson et al.

(10) Patent No.: US 7,856,941 B2
(45) Date of Patent: Dec. 28, 2010

(54) WET WIPE DISPENSER

(75) Inventors: Steven D. Nelson, 8604 Greenleaf Ave., Buena Park, CA (US) 90620; Bruce P. Carey, Saugus, CA (US)

(73) Assignee: Steven D. Nelson, Buena Park, CA (US)

( * ) Notice: Subject to any disclaimer, the term of this patent is extended or adjusted under 35 U.S.C. 154(b) by 604 days.

(21) Appl. No.: 11/863,743

(22) Filed: Sep. 28, 2007

(65) Prior Publication Data

US 2009/0084811 A1 Apr. 2, 2009

(51) Int. Cl.

| | |
|---|---|
| ***B05B 13/02*** | (2006.01) |
| ***B05B 15/04*** | (2006.01) |
| ***B65H 5/28*** | (2006.01) |
| ***B65D 83/28*** | (2006.01) |

(52) U.S. Cl. ..... 118/325; 118/301; 118/504; 118/313; 118/314; 118/315

(58) Field of Classification Search ..... 118/325, 118/324, 313–315, 235, 234, 420, 301, 504; 68/205 R, 13 R; 222/180; 221/71, 135, 282
See application file for complete search history.

(56) References Cited

U.S. PATENT DOCUMENTS

| | | | | |
|---|---|---|---|---|
| 3,862,616 | A * | 1/1975 | Brady | 118/699 |
| 5,375,616 | A | 12/1994 | Chen | |
| 5,672,206 | A | 9/1997 | Gorman | |
| 5,829,278 | A | 11/1998 | Koo | |
| 6,314,971 | B1 | 11/2001 | Schneider | |
| 6,343,491 | B1 | 2/2002 | Jung | |
| 6,601,730 | B2 | 8/2003 | Chen | |
| 6,649,262 | B2 | 11/2003 | Hoo et al. | |
| 6,668,843 | B2 | 12/2003 | Chen | |
| 6,779,682 | B2 | 8/2004 | Chen | |

FOREIGN PATENT DOCUMENTS

| | | | |
|---|---|---|---|
| EP | 1249199 | A1 | 10/2002 |

OTHER PUBLICATIONS

Advertisement, JAD Wet Towel Machine, Model WTD-06A, Ningbo Beilun Jiada Electron Co., Ltd., (1 pg.).

* cited by examiner

*Primary Examiner*—Yewebdar T Tadesse
(74) *Attorney, Agent, or Firm*—Fulwider Patton LLP

(57) ABSTRACT

A drive for drawing an absorbent web of dry wipes from a supply and an application applying moisture to a selected width of the webs.

13 Claims, 5 Drawing Sheets

FIG. 13
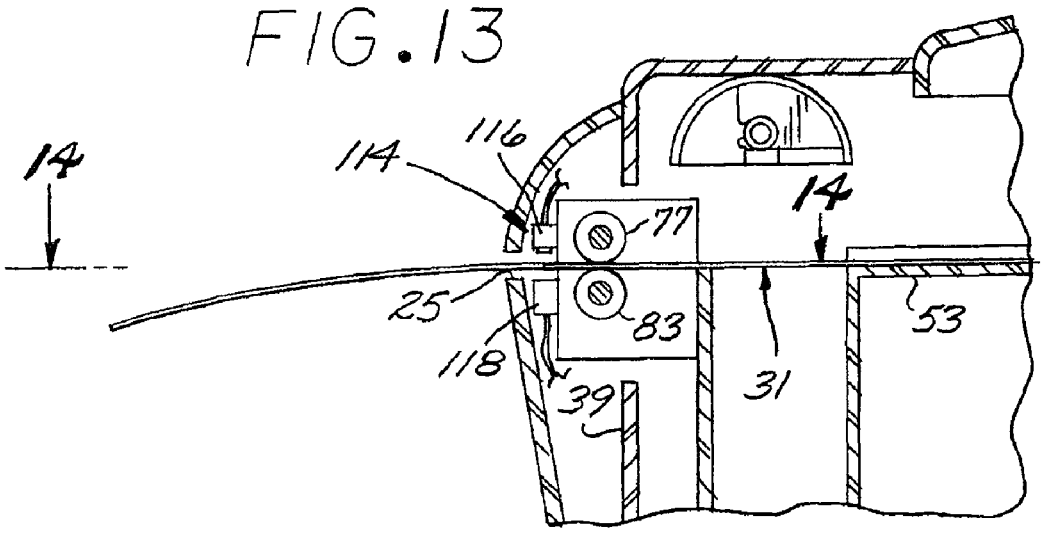
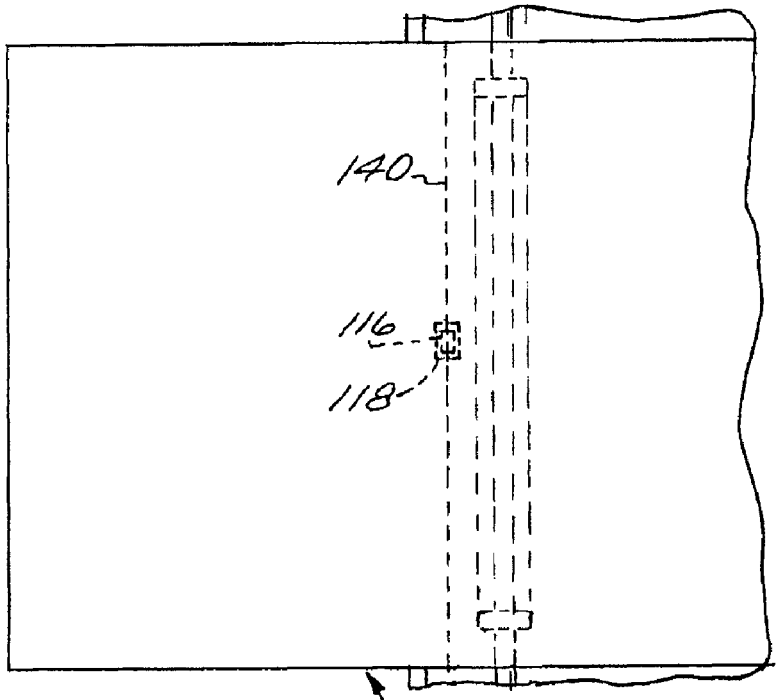
FIG. 14

WET WIPE DISPENSER

BACKGROUND OF THE INVENTION

1. Field of the Invention

The wet wipe dispenser of the present invention is adaptable for domestic use and, when wetted with chemical, has particular utility for institutional use such as medical facilities, hospitals, paramedic vehicles and in the food service business such as restaurants and fast food establishments.

2. Description of the Prior Art

It has been common practice to utilize cloth towels or paper wipes to clean soiled or contaminated surfaces. In some instances absorbent wipes or towels which may be made from treated polymers and may be available in web form stored in a roll and perforated at selected lengths for convenient separation for individual use.

Such towels have long been accepted for cleaning tasks and are utilized by applying a liquid disinfectant thereto for cleaning in and around health care facilities such as, for instance, wards in a hospital. Because of limited supply and the expense of laundering, there is always the temptation on behalf of the nurse or other medical technician to utilize a towel repeatedly, sometimes even in different hospital areas and even extending to different floors in the hospitals, wards which may house patients with different ailments or infections. This can result in cross contamination and contribute to and multiply infections in hospital areas where open or unhealed wounds may be particularly susceptible.

Thus, there exists a need for inexpensive wipes which may be conveniently moistened with various types of chemicals for disinfecting or cleansing purposes. In recognition of this need, many efforts have been made to provide a source of wipe, either individually packaged or wetted during the dispensing process.

In other unrelated areas of the art, it has been proposed to wet a strip of toilet paper as it rolls from a roll as by applying moisture thereto by capillary action or by spraying onto the roll as by means of a spray bar. Devices of this type are shown in U.S. Pat. No. 5,375,616 to Chen and in U.S. Pat. No. 5,672,206 to Gorman, respectively. Devices of this type suffer the shortcoming that the paper web or strip are often wetted to the point where they commence disintegrating even before fully dispensed or that they require a cutting device to cut the sheets of the strip to size. Cutting devices can suffer operational problems and can pose a risk of injury to the user.

Efforts to provide wetted cloth towels have led to a mechanism for a web of cloth towels with a rotary cutting device and a spray. A device of this type is shown in U.S. Pat. No. 5,829,278 to Koo. Such devices suffer the shortcoming that the cloth web is drawn through a rather circuitous path and the repetitive operation of the cutting device, over extended periods of time, can be problematic in that combination.

Other efforts to devise a satisfactory wetted roll dispenser has lead to a proposal that a web be drawn from a roll by means of drivers to pass in confronting relationship with a spray pad for spraying of disinfectant thereon so a treated sheet thereof may be torn from the body of the web along a sharp edge.

In further recognition of the need for wet towels, it has been proposed to roll towels in compact form to be wetted and packaged in individual packages for use by a consumer. Devices of this type are shown in U.S. Pat. Nos. 6,601,730 and 6,779,682 and 6,668,843 to Chen.

Other efforts have lead to design of a wet towel dispenser having controls for dispensing selected lengths of towels. A device of this type is apparently embodied in JAD WET TOWEL MACHINE, Model WTD-06A from Ningbo Beilun Jiada Electron Co., Ltd. Applicants have no knowledge of when this dispenser was first introduced.

From the above, it will be apparent that until now, users faced the dilemma of choosing between a prepackaged wipe or a wet towel dispenser which applied a liquid thereto at a rate which could sometimes saturate the entire towel length, often utilizing a cutting device for cutting treated towels to length or rather slow and un reliable dispensing devices.

SUMMARY OF THE INVENTION

The towel dispenser of the present invention includes a housing with a supply compartment for a web of absorbent material and a drive for drawing the web along a path to a dispenser opening. An applicator applies moisture to the web in a transverse swath less than the overall width of the web itself.

Other features and advantages of the invention will become apparent from the following detailed description, taken in conjunction with the accompanying drawings which illustrate, by way of example, the features of the invention.

BRIEF DESCRIPTION OF THE DRAWINGS

FIG. 13 is a partial vertical sectional view similar to FIG. 9; and

FIG. 14 is a sectional horizontal view taken along the line 14-14 and FIG. 13.

DETAILED DESCRIPTION OF THE PREFERRED EMBODIMENT

Figure 6:
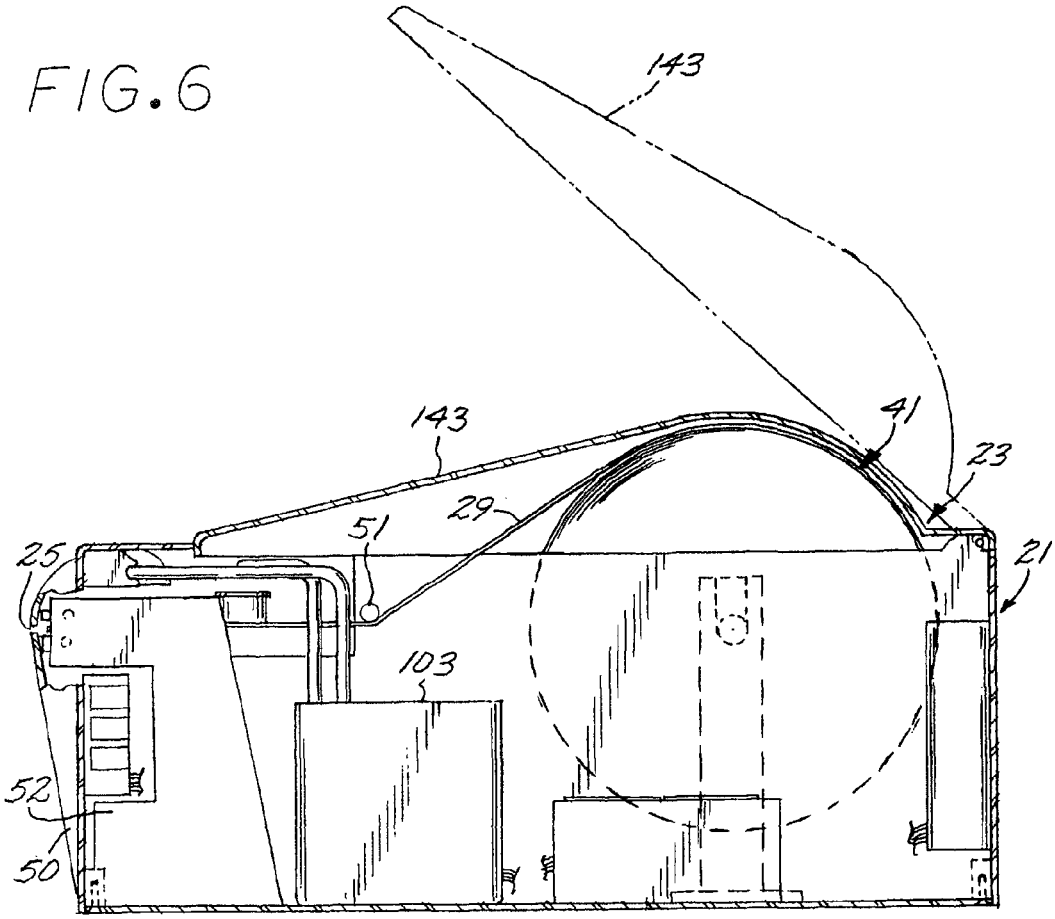
FIG. 6 is a broken sectional view, in enlarged scale, taken along the lines 6-6 of FIG. 3.
Figure 7:
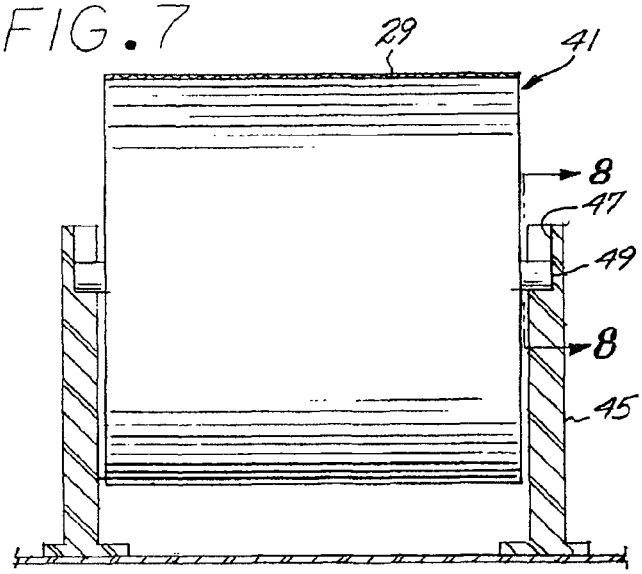
FIG. 7 is a vertical sectional view taken along the line 7-7 of FIG. 3.
Figure 8:
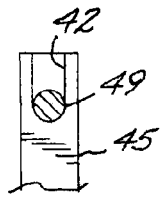
FIG. 8 is a vertical sectional view taken along the line 8-8 of FIG. 7.
Figure 9:
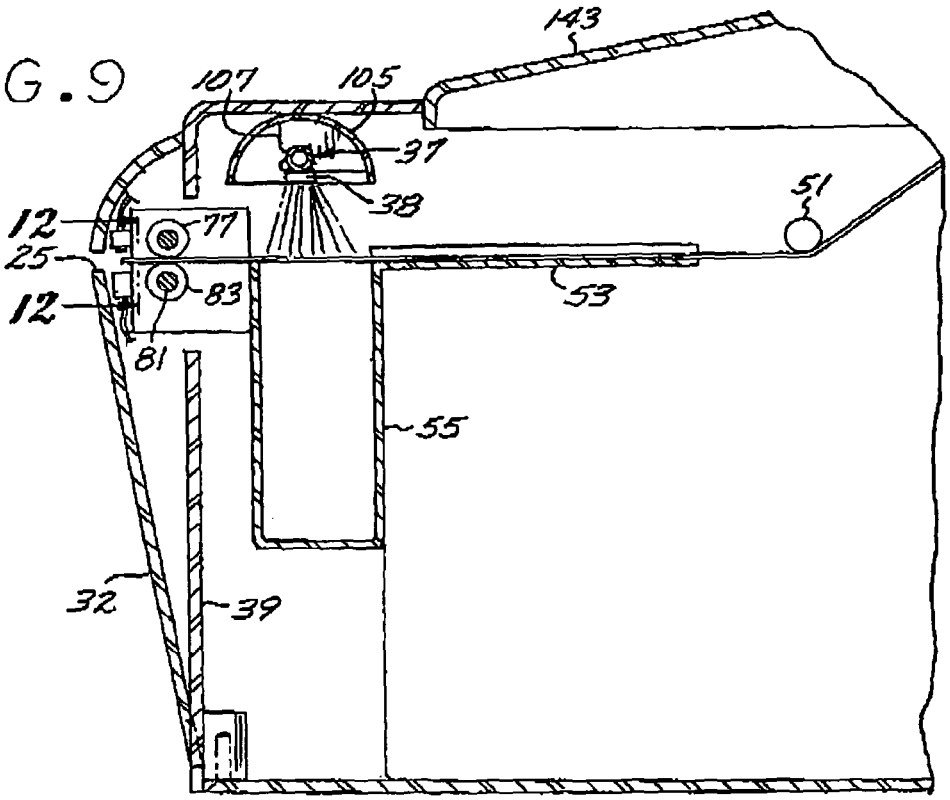
FIG. 9 is a partial vertical sectional view similar to FIG. 6 but in enlarged scale.

Referring to FIGS. 6 and 9, the wet wipe dispenser of the present invention includes, generally, a housing 21 formed at one end with a web supply compartment 23 and at its opposite end with a laterally extending outlet slot 25. A drive, generally designated 27, is provided for drawing a web 29 from the compartment 23, along a path 31 for application of moisture as it passes under an applicator nozzle bar 37. In the preferred embodiment, the nozzle bar applies the spray to the web along a swath 113 having a width less than that of the web to thus leave one or more longitudinal belts 111 of the web which are essentially dry to thereby maintain its integrity against disintegration by moisture.

The wet towel dispenser of the present invention may be constructed for many different applications, such as in a large scale industrial model which may accept a roll, generally designated 41 (FIG. 1), of a moisture absorbing web generally referred to as paper towels, which is typically made of various combinations of polymers and the like to afford the desired absorptive characteristics and strength and durability. The industrial model may be mounted on a hand cart for conveniently transported about the floor of a restaurant or medical facility such as a hospital. In other embodiments, the wet towel dispenser of the present invention may be constructed on a smaller scale to be conveniently mounted on the kitchen wall or, possibly, in a cabinet under the kitchen sink for easy access by the homemaker or other cleaning personnel.

Currently the need for quick and easy access to treated absorbent towels and wipes is well recognized in the institutional area, particularly in the health service fields. The ready and inexpensive availability of disposable wetted wipes will tend to discourage reuse and the consequent risk of cross contamination which tends to spread bacteria and the like. Further, safety can be well served by ready access to inexpensive wipes wetted with chemicals or disinfectants which may incorporate bactericidal components. It is this need to which the present invention is directed.

The front of the housing 21 is configured with an upwardly and forwardly inclined front wall 32 and vertical false wall 34 (FIG. 9).

In the present invention, the housing 21 may in some instances be sized to receive an roll of industrial absorbent web and large quantities of chemicals to be sprayed on the web or may be a more compact arrangement such as would be mounted in a cabinet or underneath a kitchen sink. The supply compartment may take many different forms such as compartment for receipt of a web arrangement in the form of a fan fold, a reel or a roll 41 from which the web may be drawn from the core thereof or from the periphery as shown in FIG. 6.

In some embodiments, an ultraviolet light will be mounted on the exterior housing to be actuated by healthcare personnel, such as paramedics, to flash on his or her hands to detect any bacteria which should be removed by the chemical carried on the wipe.

Figure 3:
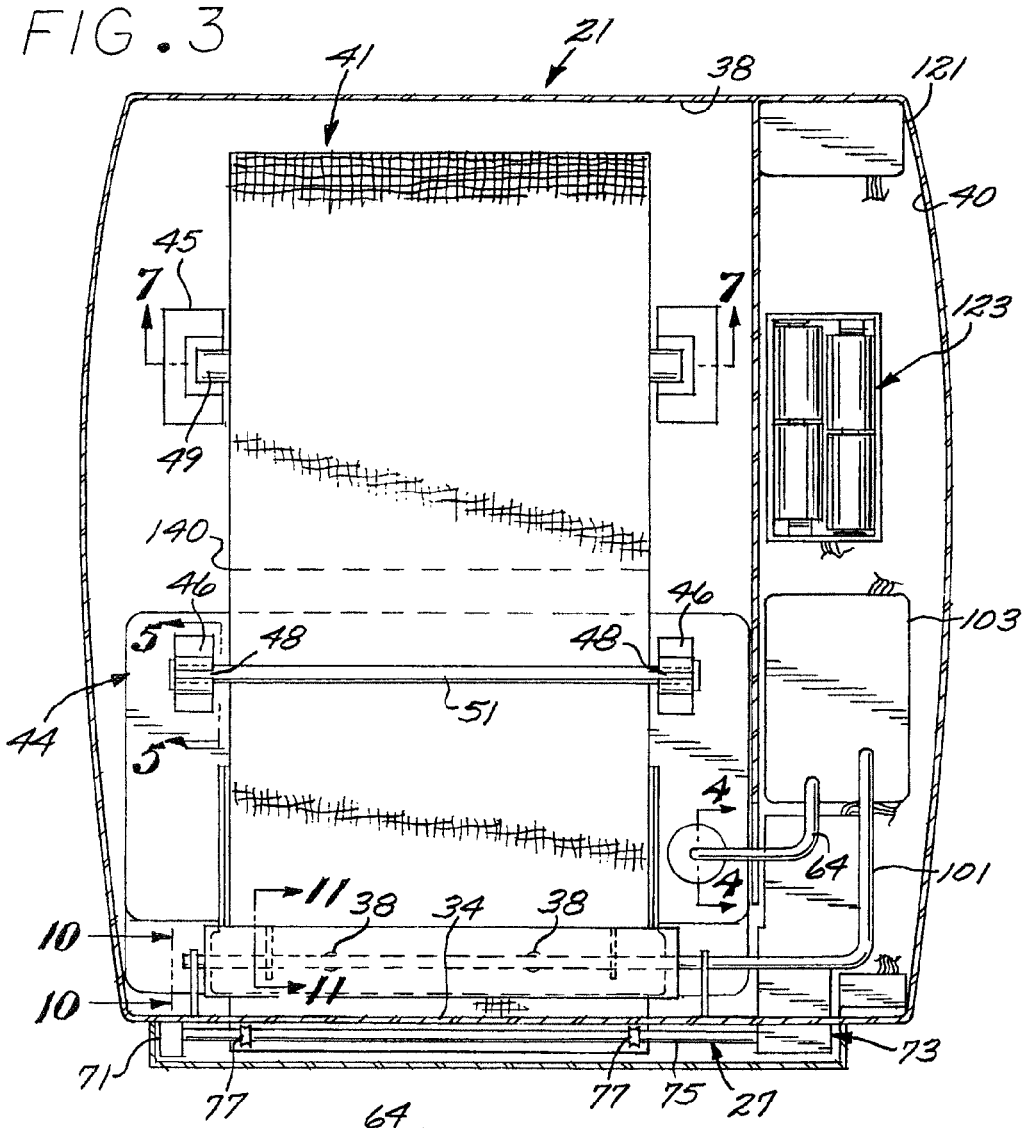
FIG. 3 is a horizontal sectional view, in enlarged scale, taken along the line 3-3 of FIG. 2.

Referring to FIG. 3, the housing 21 is formed with a central compartment 38 and a flanking forwardly opening controls compartment 40. Mounted rearwardly in the compartment 38 is a pair of upstanding mounting posts 45 spaced laterally apart and formed on their interior sides with upwardly opening blind slots 47 for receipt of the respective opposite ends of a rod 49 mounting the roll 41.

Received forwardly in the compartment 38 is a chemical supply tank, generally designated 44, which mounts on its top side a pair of laterally spaced apart yokes 46 (FIG. 3) formed with upwardly opening slots 48. The supply cartridge 44 is conveniently formed in its forward section with a forwardly projecting foot 50 which defines an upwardly facing shelf 52.

Referring to FIG. 9, a recovery tank assembly, generally designated 54, is formed with an open top recovery tank 55 and includes at its top extremity a rearwardly projecting planar platen 51 overlying the forward top side of the supply cartridge 44 and formed on its laterally opposite sides with upturn guide flanges 57 cooperating to form a straight path for the web 29 to the opening 25. Conveniently, one edge of the opening 25 defines a tear bar against which the webs may be drawn to tear a wipe free.

Figure 4:
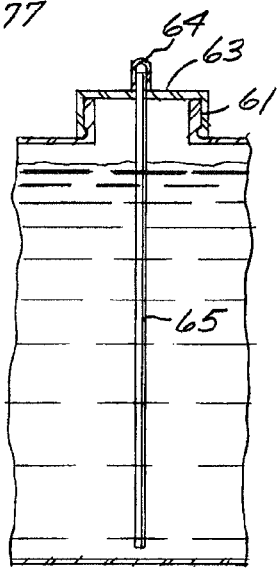
FIG. 4 is a vertical sectional view taken along the line 4-4 of FIG. 3.

The supply cartridge 44 is formed in its top side with an upwardly opening neck 61 capped by a cylindrical cap 63 (FIG. 4) from which is suspended a supply open bottom supply tube 65.

Figure 12:
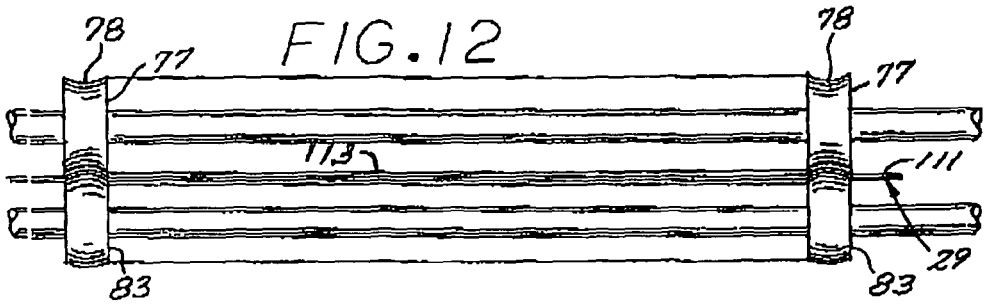
FIG. 12 is vertical sectional view, in enlarged scale, taken along the line 12-12 of FIG. 9.

Referring to FIGS. 3, 9, and 12, a bearing block 71 is mounted from the front wall of the housing 21 to support one end of the drive 27. The drive includes a pair of vertically spaced apart, transverse, parallel rods 75 and 81 (FIG. 12) which mount respective elongated cylindrical rollers 76 and 78 thereon. The rollers are of sufficient diameters there between to maintain their peripheries spread apart about ¼" to allow the wetted webs to feed through the space without squeezing the liquid therefrom. The drive 27 also includes on one end a motor housing, generally designated 73, received forwardly in the control compartment 40 to mount one end of the drive rod 75 which mounts in laterally spaced apart relationship a pair of drive wheels 77 (FIG. 12) which are formed on their peripheries with concave grooves. In the preferred embodiment, the web has a width of approximately 12 inches and the wheels 77 are spaced laterally apart about 10 inches and are about 1 inch wide with their confronting surfaces tracking along opposite sides of the web to cooperate in drawing the unwetted portion of the web. In this regard, the idler rod 81 mounts a pair of idler wheels 83 spaced apart the same distance, and having the same width, as the drive wheels 77, and are further being formed with respective convex peripheries to complimentarily engage the respective concave grooves 78 of the respective drive wheels 77.

Figure 10:
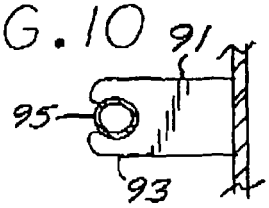
FIG. 10 is a vertical sectional view, in enlarged scale, taken along the line 10-10 of FIG. 3.

Mounted from the back side of the intermediate front wall 34 is a pair of rearwardly projecting, laterally spaced apart mounting stems 91 (FIGS. 3 and 10) formed with rearwardly opening semi-circular slots 93, respectively, for frictional receipt of the opposite ends of an applicator spray bar, generally designated 95, which cooperates to act as the applicator 37.

With the continued reference to FIG. 3, the spray bar 37 is formed with a turned back elbow fitting 101 which feeds from the outlet of an electric pump 103. It will be appreciated that the elbow fitting 64 from the cartridge cap 63 feeds into the inlet of such pump.

As noted in FIG. 3, the spray head 37 includes a pair of nozzles 38 directed downwardly toward the web. As will be appreciated by those skilled in the art, in some instances, the spray head 37 will include only a single nozzle and other arrangements there will be multiple nozzles. Additionally, the guidance and focusing of the spray on the swath 113 can be achieved in many different ways, such as precise spraying thereof, in some instances, by a roller applicator and in even other instances by passing the web through a moisturizing bath with a controlled quantity of chemicals therein.

Figure 11:
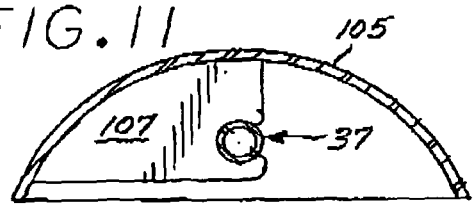
FIG. 11 is a vertical sectional view, in enlarged scale, taken along the line 11-11 of FIG. 3.

As shown in FIGS. 3, 9 and 11, a semi-cylindrical, downwardly opening spray cover 105 is mounted over the spray tube to operate in directing the spray from the nozzles downwardly. Mounted in laterally and horizontally spaced apart relationship under such spray cover and spaced slightly inwardly toward the longitudinal center from the alignment with the drive wheels 77 and 83, are a pair of forwardly and rearwardly projecting vertical spray shields 107. These longitudinal sheets cooperate in shielding the spray from the nozzles from spraying laterally outwardly to thereby cooperate in maintaining the marginal edges of the web dry to form what might be considered dry belts 111 disposed on opposite sides of a centrally disposed swath 113 of wetted webs formed between the wheels 77 and 83 (FIG. 12).

Referring to FIGS. 9 and 14, a motion sensor, generally designated 114, is mounted adjacent the opening 25. The sensor may include a light 116 and light sensor 118 disposed, respectively on opposite sides of the path of the web as driven through the driving idler wheels, 78 and 83, respectively. The detector 118 is operative to sense light energy from the light 116 projected through perforations in the web to thus detect proper registration of such perforations relative to the opening 25 and to generate an electrical signal when a perforation is detected.

Referring to FIG. 3, mounted rearwardly in the control compartment 40 is an AC adapter 121 for connection with 110 AC power source. Mounted centrally in such compartment 40 is a DC battery pack, generally designated 123, for operating the system off of dry cell batteries.

Figure 1:
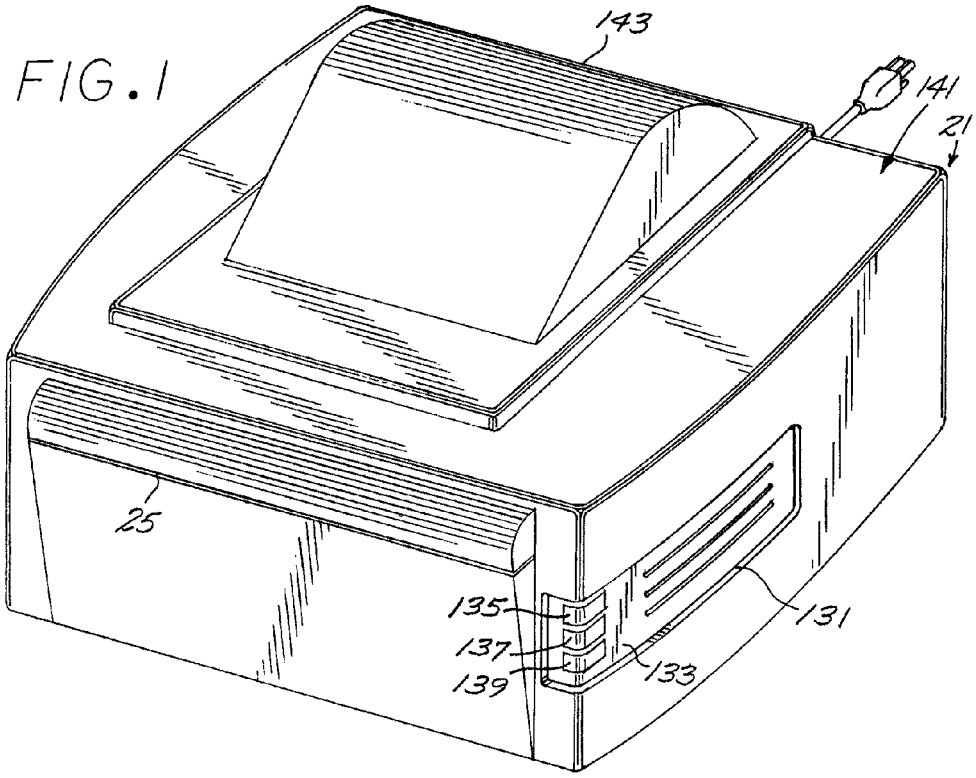
FIG. 1 is a prospective view of a wipe dispenser embodying the present inversion.
Figure 2:
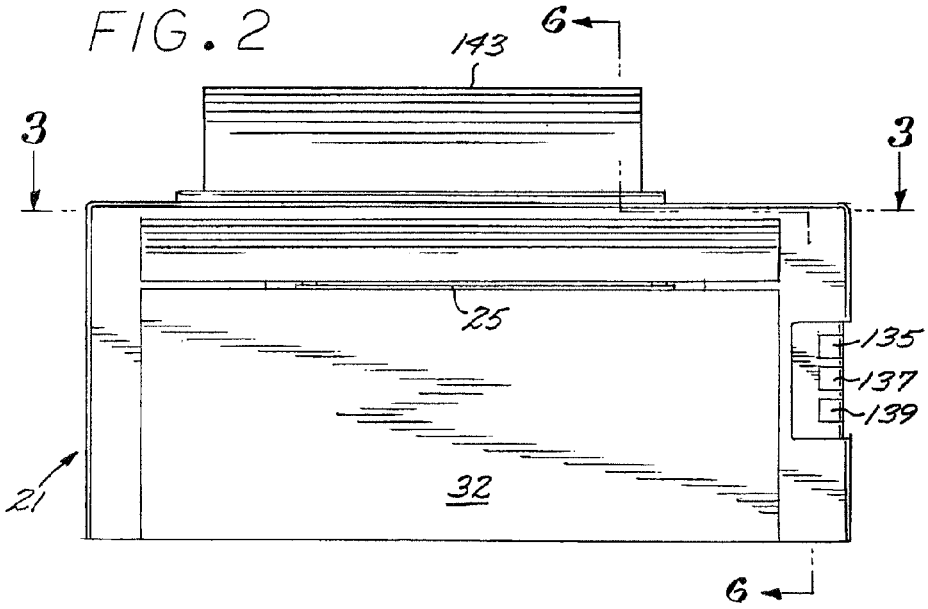
FIG. 2 is a front view of the wipe dispenser shown in FIG. 1, in enlarged scale.

Referring to FIGS. 1 and 2, the housing 21 is formed in the forward portion of one side wall with a laterally and forwardly opening control window 131 which exposes a control panel 133 of a computer control which includes an on/off switch 135, dry wiper switch 137 and wipe length switch 139.

Hingedly mounted to the top rear of the housing 21 is a cover, generally designated 141, formed centrally with a raised dome 143 passing over the upper periphery of the roll 41 and configured to close the top opening of such housing.

As will be appreciated by those skilled in the art, a properly programmed control card may be inserted in the computer to control the overall operation. The control card will be programmed for the particular application of the dispenser.

Figure 5:
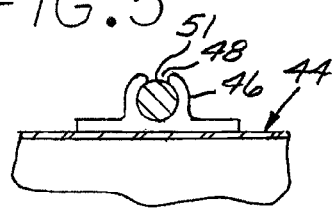
FIG. 5 is a vertical sectional view, in enlarged scale, taken along the line 5-5 of FIG. 3.

In operation, it will be appreciated that the user can open the cover 143 to expose the interior compartments 38 and 44. A fully charged supply cartridge 44 may be inserted and the recovery tank assembly nested thereon shown in FIG. 9. The mounting rod 49 may be inserted through the center of a roll 41 and the roll inserted in the compartment 23 to nest the opposite ends of such rod in the slots 47 of the posts 45. The lead end of the web 49 may be drawn off the roll and along the linear path 31 over the platen 53 to be fed between the rollers 76 and 80 and between the nip of the drive wheels 77 and 83. The free extremity of the web will be threaded between the light 116 and sensor 118 (FIG. 13) and out the slot 25. The control bar 51 may then be positioned over the web as shown in FIG. 3 and the opposite ends thereof snapped into place within the slots 48 as shown in FIG. 5.

The switch 135 may then be depressed to turn the system on and the user can select the length of web he or she desires to dispense, for instance 12, 24 or 36 inches in length. Each depression of the control button 137 will operate generate a control signal to drive the drive motor a sufficient number of rotations to dispense a 12 inch length of web. The web is preferably perforated in transverse lines 140 every 12 inches in coordination with the drive so that at the conclusion of each incremental advancement, a perforation line is located in alignment with the outlet 25 so that by tearing up or down or even sideways, the exposed length of web can be severed.

As the drive rod 75 is rotated the wheels 77 and 83 will cooperate to draw the web forwardly over the platen 53 as guided by the guide flanges 57 at a speed dictated by the computer controls to, for the magnitude of spray from the nozzles, establish the desired saturation of the wetted swath of the web. As noted, the cover 105 and side shields 107 will cooperate in directing the spray to the central swath, leaving the belts on the opposite sides of the web relatively dry to maintain the structural integrity thereof as they are drawn by the wheels to drive the soon to be wipe out of the slot 25.

As the wheels 83 and 77 rotate at a predetermined rate, the spray nozzles 38 will cooperate to apply spray to the swath 113 in a continuous longitudinal swath. In some embodiments, it will be appreciated that a spray may be intermittent so that only the central portion of the web will be moistened in the areas between the perforated lines 112.

In some instances, the spray nozzles 38 are positioned toward the lateral sides of the web without spray in a central belt on the web thereby leaving the central belt of the web unwetted for structural purposes so the wheels 77 and 83 or other drive mechanism located in the lateral center will cooperate to engage the lateral center of the web to draw forwardly, in the manner described above.

As the selected number of length of web, as for instance 12, 24, or 36 inches is dispensed from the opening 25 the computer will be operative to count the rotations of the drive bar 75 to discontinue rotation thereof and stop the drive at the appropriate time with a perforated line in general registration with the dispenser opening 25. The user may then grasp the exposed length of web and draw the wipe upwardly or downwardly against one edge or the other of the dispenser opening or even draw it laterally sideways causing the web to separate the webs along the perforation line or some other defined weakened area to provide a wipe of the selected length.

In the event the drive fails to advance the web at a sufficient rate to exactly locate the perforation line 140 of the particular towel to be dispensed at the outlet 25 or, for instance, a user pulls on the previously dispensed towel in such way as to force the drive out of registration, advancement of the web will be adjusted. In this regard, when the drive is stopped, the sensor 118 will sense whether the light energy projected from the light 116 is sensed through the respective perforations of the perforation line 140 and generate a signal. The lack of such signal will be detected by the computer and the computer will be operative to operate the drive motor advance the web forwardly to the point where a perforation line 140 properly registers between the light 116 and sensor 118 to thereby maintain the overall web in registration for proper operation.

When the individual wipe is torn off, the separated wipe may be conveniently used by the operator to wipe, for instance, a sink, work table, or operating table to remove any discharge or residue and the wipe deposited in a waste container or a biological waste container. Then, if other areas are to be cleaned, as for instance, a floor or wall area, the user may dispense another length of wipe, with or without the spray to clean that area without concern for cross contamination or spread of bacteria or disease carrying waste.

As will be appreciated, the user may conveniently dispense one or more lengths of dry towel by merely pressing the button 139 to dispense the desired increment of, for instance, 12, 24, or 36 inches of web to thus have ready access to a dry wipe without the necessity of resorting to a different towel supply for drying of the claimed area.

It will be appreciated that the cartridge 44 will be filled with the particular chemical desired for the particular application. When empty, the cartridge itself will be removed and replaced by a full cartridge.

From the foregoing it will be appreciated that the wet wipe dispenser of the present invention is economically to manufacture and provides for positive dispensing of wet, or in some cases dry, wipes with the desired amount of saturation yet with the web of wipes possessing the structural integrity for effective operation of the drive mechanism without contributing to deterioration of the structural integrity of the wipe itself.

We claim:

1. A wet wipe dispenser comprising:

a housing formed at one end with a dispenser outlet;

a supply compartment for receiving an elongated wipe web of a predetermined width and formed with transverse weakened separation lines spaced predetermined distances there along to define individual wipes of respective predetermined lengths;

a driver for drawing the elongated wipe web from the supply compartment along a dispenser path to the dispenser outlet;

an applicator constructed to apply a liquid along the longitudinal center of the elongated wipe web in a swath having a width less than the predetermined width as it is drawn along the dispenser path to leave dry belts on the flanking sides of the elongated wipe web; and a control for actuating the driver to draw the predetermined length of the elongated wipe web along the path toward the dispenser outlet and actuating the applicator to apply the liquid in the swath to at least a portion of one of the selected lengths of the elongated wipe web as it is driven toward the outlet.

2. The wet wipe dispenser of claim 1 wherein:

the compartment includes a mount for mounting a roll of the wiper web.

3. The wet wipe dispenser of claim 1 wherein:

the applicator includes a spray nozzle.

4. The wet wipe dispenser of claim 1 wherein:

the control includes a computer for controlling the driver and applicator.

5. The wet wipe dispenser of claim 1 wherein:

the applicator includes a spray bar formed with a plurality of laterally spaced nozzles and includes a shield device directing the spray from the nozzles to the elongated wipe web.

6. The wet wipe dispenser of claim 1 wherein:

the driver includes at least a pair of friction wheels engaging the elongated wipe web.

7. The wet wipe dispenser apparatus of claim 6 wherein:

one of the friction wheels is formed with a laterally convex periphery and the other of the friction wheels is formed with a laterally concave periphery to complementally engage the elongated wipe web with the convex periphery.

8. The wet wipe dispenser of claim 1 wherein:

the driver includes a pair of transversely elongated rollers and a plurality of wheels spaced longitudinally along the rollers to frictionally engage the elongated wipe web.

9. The wet wipe dispenser of claim 1 wherein:

the control is operative to activate the driver independent of the applicator.

10. The wet wipe device of claim 1 wherein:

the dispenser path is planer and the dispenser outlet is disposed in the same plane as the path.

11. The wet wipe device of claim 1 that includes:

a liquid supply cartridge in the housing connected with the applicator.

12. The wet wipe dispenser of claim 1 wherein:

the control is operative to selectively actuate the driver to selectively draw selected numbers of the predetermined lengths of the elongated wipe web and to actuate the driver independent of the applicator; and the control includes a first switch for selecting numbers of the lengths desired and a second switch to actuate the driver without actuating the applicator.

13. A wet wipe dispenser comprising:

a housing formed at one end with a dispenser outlet;

a supply compartment for receiving an elongated wipe web of a predetermined width and formed with transverse weakened separation lines spaced predetermined distances there along to define individual wipes of respective predetermined lengths;

a drive including friction wheels to engagingly rotate against the elongated wipe web to, with a selected number of rotations, draw predetermined lengths of elongated wipe web from the supply compartment and dispose one of the weakened lines adjacent the dispenser outlet;

an applicator for applying a liquid to the elongated wipe web in a swath having a width less than the predetermined width as it is drawn along the dispenser path to leave a dry belt along the elongated wipe web; and a control for actuating the driver to draw the predetermined length of the elongated wipe web along the path toward the dispenser outlet and actuating the applicator to apply the liquid in the swath to at least a portion of one of the selected lengths of the elongated wipe web as it is driven toward the dispenser outlet, the control further an operative to, upon the friction wheels being rotated the selected number of rotations and, the concurrent absence of a registration signal, to advance the driver until the sensor senses a weakened line to generate a registration signal to be communicated to the driver to stop the driver.

* * * * *